US007832732B1

(12) United States Patent
Torres et al.

(10) Patent No.: US 7,832,732 B1
(45) Date of Patent: Nov. 16, 2010

(54) GAME WITH INTERLOCKING GAME PIECES

(76) Inventors: Pedro A. Torres, 1101/D, San Marcos, TX (US) 78666; Mary B. Torres, 1101/D, San Marcos, TX (US) 78666

( * ) Notice: Subject to any disclaimer, the term of this patent is extended or adjusted under 35 U.S.C. 154(b) by 96 days.

(21) Appl. No.: 12/249,940

(22) Filed: Oct. 12, 2008

(51) Int. Cl.
*A63F 9/20* (2006.01)
*A63F 1/02* (2006.01)

(52) U.S. Cl. ..... 273/294; 273/293; 273/288; 273/157 R; 273/160; 273/153 R; D21/391; D21/386; D21/480

(58) Field of Classification Search ..... 273/294, 273/293, 288, 157 R, 275, 276, 160, 153 R; 434/171, 172; D21/391, 376, 386, 480
See application file for complete search history.

(56) References Cited

U.S. PATENT DOCUMENTS

| | | | | | |
|---|---|---|---|---|---|
| D38,868 | S | * | 11/1907 | Thomas | D21/391 |
| 3,924,859 | A | * | 12/1975 | Kramer | 273/294 |
| 5,346,225 | A | * | 9/1994 | Walling | 273/294 |
| 6,626,678 | B2 | * | 9/2003 | Forbes et al. | 434/247 |

* cited by examiner

*Primary Examiner*—Benjamin H Layno

(57) ABSTRACT

A game with interlocking game pieces includes a first set of game pieces each comprising a game surface, a first side surface having a first concave portion and a first convex portion extending from the first concave portion and a second side surface having a second concave portion and a second convex portion extending from the second concave portion. A second set of game pieces are mirror images of and interlock with the first set of game pieces. A game piece face provided on the game surface of each of the first set of game pieces and the second set of game pieces.

12 Claims, 2 Drawing Sheets

GAME WITH INTERLOCKING GAME PIECES

FIELD OF THE INVENTION

The present disclosure relates to games. More particularly, the present disclosure relates to a game with interlocking game pieces which can be interlocked to match adjacent pieces such as in the playing of dominoes, for example.

BACKGROUND OF THE INVENTION

Games such as dominoes have provided hours of entertainment for people over the years. In dominoes, each of multiple game pieces has from one to six dots on each end of the game piece. The players take turns placing game pieces on a flat surface while matching the number of dots on an end of each game piece with the same number of dots on an exposed or un-played end of a game piece which has already been played. The players may keep score by recording and adding the number of dots matched in each play.

A game is needed which has multiple interlocking game pieces adjacent ones of which can be interlocked with each other in the matching of the adjacent pieces in a game such as dominoes, for example.

SUMMARY

The present disclosure is generally directed to a game with interlocking game pieces. An illustrative embodiment of the game includes a first set of game pieces each comprising a game surface, a first side surface having a first concave portion and a first convex portion extending from the first concave portion and a second side surface having a second concave portion and a second convex portion extending from the second concave portion. A second set of game pieces are mirror images of and interlock with the first set of game pieces. A game piece face provided on the game surface of each of the first set of game pieces and the second set of game pieces.

BRIEF DESCRIPTION OF THE DRAWINGS

The disclosure will now be made, by way of example, with reference to the accompanying drawings, in which.

DETAILED DESCRIPTION

The following detailed description is merely exemplary in nature and is not intended to limit the described embodiments or the application and uses of the described embodiments. As used herein, the, word "exemplary" or "illustrative" means "serving as an example, instance, or illustration." Any implementation described herein as "exemplary" or "illustrative" is not necessarily to be construed as preferred or advantageous over other implementations. All of the implementations described below are exemplary implementations provided to enable persons skilled in the art to make or use the invention and are not intended to limit the scope of the invention which is defined by the claims. Furthermore, there is no intention to be bound by any expressed or implied theory presented in the preceding technical field, background, brief summary or the following detailed description.

Figure 1:
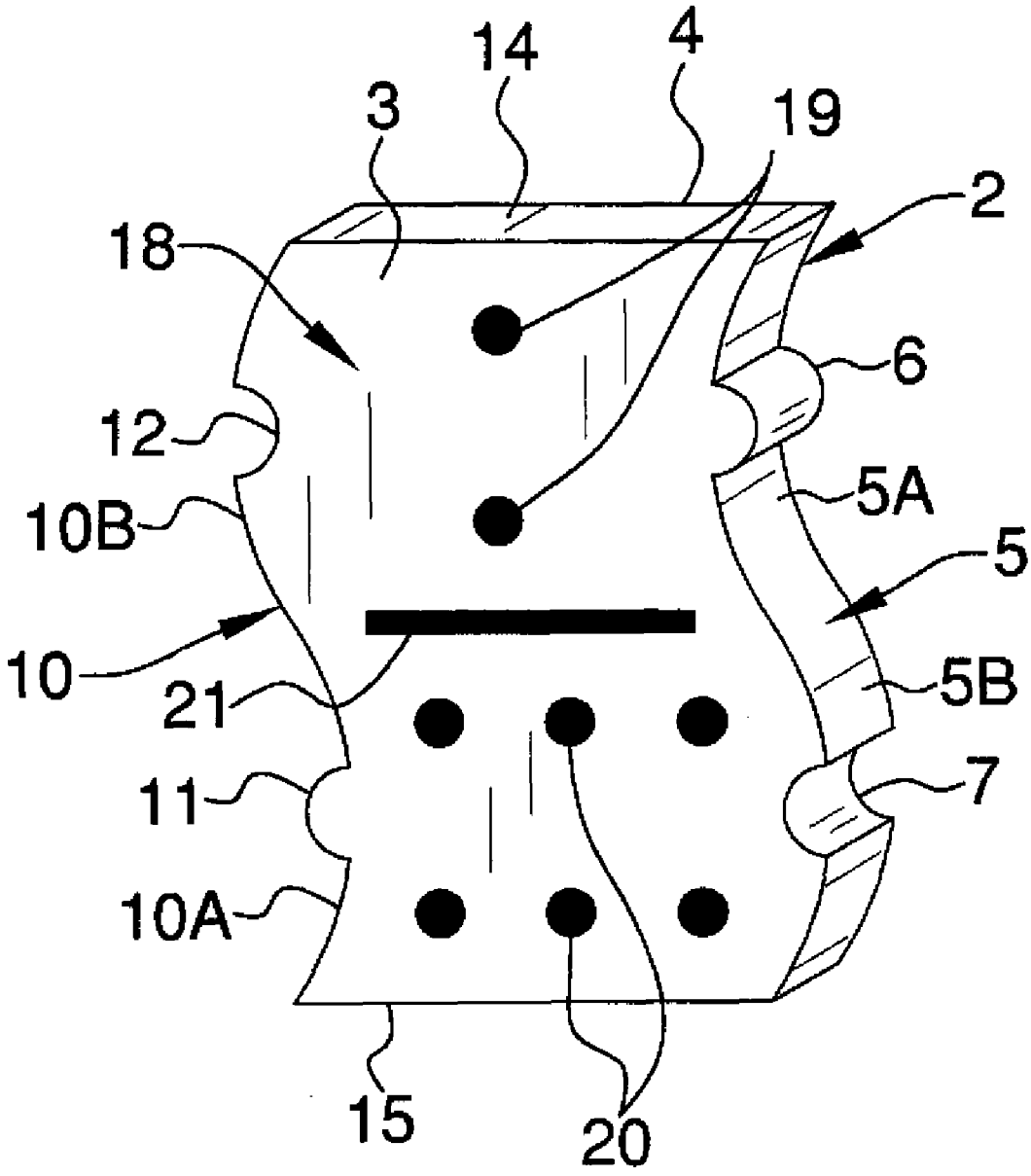
FIG. 1 is a front perspective view of a game piece of an illustrative embodiment of the game with interlocking game pieces, with a domino game piece face provided on the game piece.

Referring to the drawings, an illustrative embodiment of the game with interlocking game pieces, hereinafter game, is generally indicated by reference numeral 1 in FIG. 2. The game 1 includes a first set of game pieces 2 and a second set of game pieces 2*a*. Each game piece 2*a* is, a mirror image of each game piece 2. The game pieces 2, 2*a* can be fitted together in interlocking relationship with respect to each other pursuant to game rules as will be hereinafter described. In the embodiment of the game 1 which is shown in FIG. 1, the game pieces 2, 2*a* simulate dominoes game pieces which may be fitted together in playing of a game of dominoes. However, it will be apparent to those of skilled in the art that the game pieces 2, 2*a* may alternatively be adapted to simulate game pieces for use in other matching games such as in letter matching games to form words or in the simulation of playing cards for the matching of suites or denominations on the playing cards, for example and without limitation.

Each game piece 2 may be plastic or other rigid material, or may be a flexible material such as rubber. Each game piece 2 has a generally elongated shape and includes a game surface 3 on which appears a game piece face 18. A flat support surface 4 is opposite the game surface 3 and contacts a supporting surface (not shown) such as a table top, for example, during play of the game 1. A first side surface 5 has a wavy configuration, with a concave portion 5*a* and an adjacent convex portion 5*b* which extends from and is continuous with the concave portion 5*a*. An interlock tab 6 protrudes into the concave portion 5*a*. An interlock tab groove 7 is provided in the convex portion 5*b*.

A second side surface 10 of each game piece 2 has a wavy configuration which is the reverse of that of the first side surface 5. Accordingly, the second side surface 10 has a concave portion 10*a* which is directly opposite the convex portion 5*b* of the first side surface 5. An interlock tab 11 protrudes into the concave portion 10*a*. A convex portion 10*b* extends from and is continuous with the concave portion 10*a*. The convex portion 10*b* of the second side surface 10 is directly opposite the concave portion 5*a* of the first side surface 5. An interlock tab groove 12 is provided in the convex portion 10*b*. Each game piece 2 further includes a generally flat or planar first end surface 14 and a generally flat or planar second end surface 15 which are generally parallel to each other.

As further shown in FIG. 1, in some embodiments of the game 1, the game piece face 18 of each game piece 2 simulates a dominoes game piece. Accordingly, a first set of domino dots 19 is provided on the game surface 3 at one end of the game piece 2. A second set of domino dots 20 is provided on the game surface 3 at the other end of the game piece 2. A dividing line 21 may extend between the first set of domino dots 19 and the second set of domino dots 20.

Figure 2:
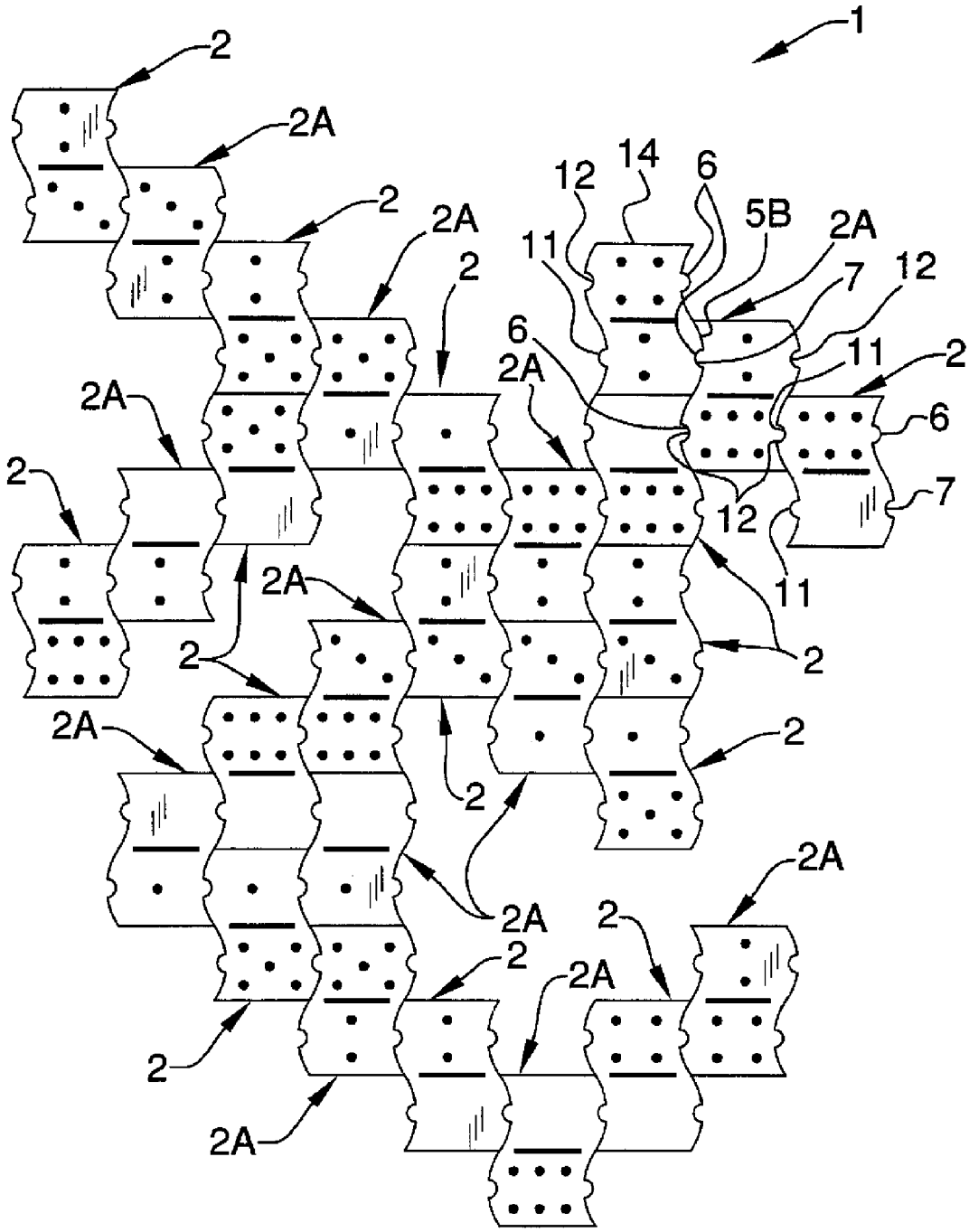
FIG. 2 is a front view of multiple game pieces interlocking with each other in a game of dominoes.

As shown in FIG. 2, the game 1 may be played according to rules of a conventional game of dominoes. Accordingly, multiple players sequentially place the game pieces 2, 2*a* on a supporting surface (not shown) such as a table. Each player attempts to match the number of the first set of domino dots 19 with the number of the second set of domino dots 20 of a game piece 2, 2*a* which has already been played. Adjacent game pieces 2, 2*a* can be interlocked together by inserting an interlock tab 6 or interlock tab 11 of a game piece 2 into the congruent interlock tab groove 7 or interlock tab groove 12 of an adjacent game piece 2*a*. The first end surface 14 of one game piece 2 can be placed against the second end surface 15 of an adjacent game piece 2. Similarly, the first end surface 14 of one game piece 2*a* can be placed against the second end surface 15 of an adjacent game piece 2*a*. At the conclusion of the game, the game pieces 2, 2*a* can be separated from each other by removing the interlock tabs 6 and interlock tabs 11 from the respective interlock tab grooves 7 and interlock tab grooves 12, respectively.

It will be appreciated by those skilled in the art that in variations of the game 1 the game piece face 18 on each game piece 2, 2*a* can include letters, numbers, playing card faces or other symbols which can be matched by interlocking the game pieces 2, 2*a* with each other. For example, in the case of letters provided on the game surface 3 of each game piece 2, 2*a*, the game pieces 2, 2*a* can be interlocked with each other to spell words. In the case of numbers provided on the game surface 3 of each game piece 2, 2*a*, the game pieces 2, 2*a* can be interlocked with each other to form an ascending or descending sequence of numbers.

While the preferred embodiments of the disclosure have been described above, it will be recognized and understood that various modifications can be made in the disclosure and the appended claims are intended to cover all such modifications which may fall within the spirit and scope of the disclosure.

What is claimed is:

1. A game with interlocking game pieces, comprising:

a first set of game pieces each comprising:

a game surface;

a first side surface having a first concave portion and a first convex portion extending from said first concave portion;

a second side surface having a second concave portion and a second convex portion extending from said second concave portion;

wherein said second concave portion of said second side surface is opposite said first convex portion of said first side surface and said second convex portion of said second side surface is opposite said first concave portion of said first side surface;

a second set of game pieces being mirror images, respectively, of said first set of game pieces; the second set of game pieces has the same number of game pieces as in said first set of game pieces; and a game piece face provided on said game surface of each of said first set of game pieces and said second set of game pieces.

2. The game of claim 1 wherein each of said first set of game pieces and said second set of game pieces comprises generally flat first and second end surfaces.

3. The game of claim 1 wherein said game piece face simulates a domino game piece.

4. The game of claim 1 further comprising:

a first interlock tab protruding into said first concave portion of said first side surface;

a second interlock tab protruding into said second concave portion of said second side surface;

a first interlock tab groove provided in said first convex portion of said first side surface; and a second interlock tab groove provided in said convex portion of said second side surface.

5. The game of claim 1 wherein each of said first set of game pieces and said second set of game pieces comprises plastic.

6. The game of claim 1 wherein each of said first set of game pieces and said second set of game pieces comprises rubber.

7. A game with interlocking game pieces, comprising:

a first set of game pieces each comprising:

a game surface;

a flat support surface opposite said game surface;

a first side surface having a first concave portion and a first convex portion extending from said first concave portion;

a second side surface having a second concave portion and a second convex portion extending from said second concave portion;

wherein said second concave portion of said second side surface is opposite said first convex portion of said first side surface and said second convex portion of said second side surface is opposite said first concave portion of said first side surface;

a second set of game pieces being mirror images, respectively, of said first set of game pieces; the second set of game pieces has the same number of game pieces as in said first set of game pieces; and a game piece face provided on said game surface of each of said first set of game pieces and said second set of game pieces.

8. The game of claim 7 wherein each of said first set of game pieces and said second set of game pieces comprises generally flat first and second end surfaces.

9. The game of claim 7 wherein said game piece face simulates a domino game piece.

10. The game of claim 7 further comprising:

a first interlock tab protruding into said first concave portion of said first side surface;

a second interlock tab protruding into said second concave portion of said second side surface;

a first interlock tab groove provided in said first convex portion of said first side surface; and a second interlock tab groove provided in said convex portion of said second side surface.

11. The game of claim 7 wherein each of said first set of game pieces and said second set of game pieces comprises plastic.

12. The game of claim 7 wherein each of said first set of game pieces and said second set of game pieces comprises rubber.

* * * * *